US008172219B2

(12) United States Patent
Matsumoto

(10) Patent No.: US 8,172,219 B2
(45) Date of Patent: May 8, 2012

(54) SHEET FEEDING DEVICE AND IMAGE FORMING APPARATUS HAVING SHEET FEEDING DEVICE

(75) Inventor: Yuzo Matsumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/779,474

(22) Filed: May 13, 2010

(65) Prior Publication Data

US 2010/0295237 A1 Nov. 25, 2010

(30) Foreign Application Priority Data

May 19, 2009 (JP) ..... 2009-120518

(51) Int. Cl.
*B65H 3/40* (2006.01)
*B65H 3/34* (2006.01)
*B65H 3/52* (2006.01)

(52) U.S. Cl. ..... 271/93; 271/104; 271/123; 271/124

(58) Field of Classification Search ..... 271/91, 271/93, 104, 123, 94, 97, 98, 124
See application file for complete search history.

(56) References Cited

U.S. PATENT DOCUMENTS 3,976,291 A * 8/1976 Bernardi et al. ..... 271/94
5,135,213 A * 8/1992 Malachowski et al. ..... 271/104
5,354,045 A * 10/1994 Boldrini et al. ..... 271/11
5,645,274 A * 7/1997 Ubayashi et al. ..... 271/94
6,412,769 B1 * 7/2002 Goda et al. ..... 271/94
7,540,489 B2 * 6/2009 Kushida ..... 271/98
7,568,691 B2 8/2009 Matsumoto
7,591,459 B2 9/2009 Matsumoto et al.
7,753,358 B2 * 7/2010 Ikeda ..... 271/104
7,762,544 B2 * 7/2010 Mitsuya et al. ..... 271/98
2001/0017441 A1 * 8/2001 Yamaguchi et al. ..... 271/94
2003/0222394 A1 * 12/2003 Sano et al. ..... 271/109
2007/0262512 A1 * 11/2007 Watanabe et al. ..... 271/11
2008/0191406 A1 8/2008 Fukatsu et al.
2009/0001646 A1 1/2009 Matsumoto
2009/0127768 A1 * 5/2009 Shima et al. ..... 271/97
2009/0250865 A1 10/2009 Matsumoto

FOREIGN PATENT DOCUMENTS

JP 05319591 * 12/1993
JP 2003-182873 7/2003
JP 2005-179043 7/2005
JP 3891405 3/2007

* cited by examiner

*Primary Examiner* — Kaitlin Joerger
*Assistant Examiner* — Patrick Cicchino
(74) *Attorney, Agent, or Firm* — Fitzpatrick, Cella, Harper & Scinto

(57) ABSTRACT

A sheet feeding device is provided to separate a sheet from a plurality of stacked sheets and feed the sheet. The sheet feeding device includes a sheet stacking portion on which the sheets are stacked, a suction conveyance belt which separates the sheets stacked on the sheet stacking portion, one by one and feeds the sheet, and a separation rotating roller which is rotatable upon abutting on a rear portion, in a feeding direction, of the sheets stacked on the sheet stacking portion. The separation rotating roller rotates in a direction which returns the sheet in synchronization with sheet feeding operation performed by the suction conveyance belt.

8 Claims, 19 Drawing Sheets

*FIG. 8A*

| GRAMMAGE | WHETHER SHEET IS COATED OR NOT | ENVIRONMENT IN WHICH APPARATUS IS INSTALLED T: TEMPERATURE, H: HUMIDITY | PRESSING FORCE (gfcm) |
|---|---|---|---|
| 105 g OR LESS | COATED SHEET | 30°C<T, 75%<H | 40 |
| | | 10°C<T≤30°C, 30<H≤75% | 30 |
| | | T≤10°C, H≤30 | 20 |
| | NON-COATED SHEET | 30°C<T, 75%<H | 20 |
| | | 10°C<T≤30°C, 30<H≤75% | 10 |
| | | T≤10°C, H≤30 | 0 |
| 106 TO 209 g OR LESS | COATED SHEET | 30°C<T, 75%<H | 60 |
| | | 10°C<T≤30°C, 30<H≤75% | 50 |
| | | T≤10°C, H≤30 | 40 |
| | NON-COATED SHEET | 30°C<T, 75%<H | 40 |
| | | 10°C<T≤30°C, 30<H≤75% | 30 |
| | | T≤10°C, H≤30 | 20 |
| 209 TO 300 g OR LESS | COATED SHEET | 30°C<T, 75%<H | 80 |
| | | 10°C<T≤30°C, 30<H≤75% | 70 |
| | | T≤10°C, H≤30 | 60 |
| | NON-COATED SHEET | 30°C<T, 75%<H | 60 |
| | | 10°C<T≤30°C, 30<H≤75% | 50 |
| | | T≤10°C, H≤30 | 40 |
| 300 g OR MORE | COATED SHEET | 30°C<T, 75%<H | 100 |
| | | 10°C<T≤30°C, 30<H≤75% | 90 |
| | | T≤10°C, H≤30 | 80 |
| | NON-COATED SHEET | 30°C<T, 75%<H | 80 |
| | | 10°C<T≤30°C, 30<H≤75% | 70 |
| | | T≤10°C, H≤30 | 60 |

*FIG. 8B*

| GRAMMAGE | WHETHER SHEET IS COATED OR NOT | ENVIRONMENT IN WHICH APPARATUS IS INSTALLED T: TEMPERATURE, H: HUMIDITY | VELOCITY V1 (mm/s) |
|---|---|---|---|
| 105 g OR LESS | COATED SHEET | 30°C<T, 75%<H | $V_0 \times 1.0$ |
| | | 10°C<T≤30°C, 30<H≤75% | $V_0 \times 0.99$ |
| | | T≤10°C, H≤30 | $V_0 \times 0.98$ |
| | NON-COATED SHEET | 30°C<T, 75%<H | $V_0 \times 0.98$ |
| | | 10°C<T≤30°C, 30<H≤75% | $V_0 \times 0.97$ |
| | | T≤10°C, H≤30 | $V_0 \times 0.96$ |
| 106 TO 209 g OR LESS | COATED SHEET | 30°C<T, 75%<H | $V_0 \times 0.96$ |
| | | 10°C<T≤30°C, 30<H≤75% | $V_0 \times 0.94$ |
| | | T≤10°C, H≤30 | $V_0 \times 0.92$ |
| | NON-COATED SHEET | 30°C<T, 75%<H | $V_0 \times 0.92$ |
| | | 10°C<T≤30°C, 30<H≤75% | $V_0 \times 0.90$ |
| | | T≤10°C, H≤30 | $V_0 \times 0.88$ |
| 209 TO 300 g OR LESS | COATED SHEET | 30°C<T, 75%<H | $V_0 \times 0.93$ |
| | | 10°C<T≤30°C, 30<H≤75% | $V_0 \times 0.90$ |
| | | T≤10°C, H≤30 | $V_0 \times 0.87$ |
| | NON-COATED SHEET | 30°C<T, 75%<H | $V_0 \times 0.87$ |
| | | 10°C<T≤30°C, 30<H≤75% | $V_0 \times 0.84$ |
| | | T≤10°C, H≤30 | $V_0 \times 0.81$ |
| 300 g OR MORE | COATED SHEET | 30°C<T, 75%<H | $V_0 \times 0.9$ |
| | | 10°C<T≤30°C, 30<H≤75% | $V_0 \times 0.85$ |
| | | T≤10°C, H≤30 | $V_0 \times 0.8$ |
| | NON-COATED SHEET | 30°C<T, 75%<H | $V_0 \times 0.8$ |
| | | 10°C<T≤30°C, 30<H≤75% | $V_0 \times 0.75$ |
| | | T≤10°C, H≤30 | $V_0 \times 0.7$ |

*FIG. 16*

| GRAMMAGE | WHETHER SHEET IS COATED OR NOT | ENVIRONMENT IN WHICH APPARATUS IS INSTALLED T: TEMPERATURE, H: HUMIDITY | AMOUNT OF MOVEMENT (mm) |
|---|---|---|---|
| 105 g OR LESS | COATED SHEET | 30°C<T, 75%<H | 6 |
| | | 10°C<T≤30°C, 30<H≤75% | 5.5 |
| | | T≤10°C, H≤30 | 6 |
| | NON-COATED SHEET | 30°C<T, 75%<H | 5 |
| | | 10°C<T≤30°C, 30<H≤75% | 4.5 |
| | | T≤10°C, H≤30 | 5 |
| 106 TO 209 g OR LESS | COATED SHEET | 30°C<T, 75%<H | 5 |
| | | 10°C<T≤30°C, 30<H≤75% | 4.5 |
| | | T≤10°C, H≤30 | 5 |
| | NON-COATED SHEET | 30°C<T, 75%<H | 4 |
| | | 10°C<T≤30°C, 30<H≤75% | 3.5 |
| | | T≤10°C, H≤30 | 4 |
| 209 TO 300 g OR LESS | COATED SHEET | 30°C<T, 75%<H | 4 |
| | | 10°C<T≤30°C, 30<H≤75% | 3.5 |
| | | T≤10°C, H≤30 | 4 |
| | NON-COATED SHEET | 30°C<T, 75%<H | 3 |
| | | 10°C<T≤30°C, 30<H≤75% | 2.5 |
| | | T≤10°C, H≤30 | 3 |
| 300 g OR MORE | COATED SHEET | 30°C<T, 75%<H | 3 |
| | | 10°C<T≤30°C, 30<H≤75% | 2.5 |
| | | T≤10°C, H≤30 | 3 |
| | NON-COATED SHEET | 30°C<T, 75%<H | 2 |
| | | 10°C<T≤30°C, 30<H≤75% | 1.5 |
| | | T≤10°C, H≤30 | 2 |

SHEET FEEDING DEVICE AND IMAGE FORMING APPARATUS HAVING SHEET FEEDING DEVICE

BACKGROUND OF THE INVENTION

1. Field of the Invention

The present invention relates to a sheet feeding device and an image forming apparatus having the sheet feeding device for separating a sheet from a plurality of stacked sheets and feeding each separated sheet.

2. Description of the Related Art

In an image forming apparatus such as a printer and a copier, a sheet feeding device has been used to separate a sheet from sheets stacked on a sheet stacking portion and feeding each separated sheet. Recently, in order to convey sheets at a high rate in the above sheet feeding device, a so-called air sheet feeding device has been suggested. In the air sheet feeding device, a fan is actuated to blow gas (mainly air) to the side face at the upper portion of the sheets stacked on a sheet stacking portion, so that multiple sheets at the topside of the stacked sheets are blown up. At this occasion, the topmost sheet is sucked to and fed by a conveyance belt (see U.S. Pat. No. 5,645,274).

In the air sheet feeding device, an auxiliary separation fan has been suggested to be attached to a side-end restricting plate for restricting the side end of stacked sheets, so that air is blown from an opening arranged on the side-end restricting plate. With this structure, sheets are blown up and separated more reliably (see Japanese Patent Application Laid-Open No. 2003-182873).

There exists an air sheet feeding device having a forward conveyance roller arranged on the upstream side of the suction/feeding mechanism, so that a sheet is fed by this forward conveyance roller and is thereafter sucked to and fed by the conveyance belt (see Japanese Patent Laid-Open No. 2005-179043).

In a recent image forming apparatus, sheets are fed at a high rate, and accordingly, a sheet feeding device often employs the above air sheet feeding method. However, as the apparatus is used in various environments and various sheet materials are used, a so-called multi-feeding (two or more sheets are fed at a time) is likely to occur.

SUMMARY OF THE INVENTION

The present invention is accomplished in view of the foregoing circumstance and provides a sheet feeding device and an image forming apparatus having the sheet feeding device that can separate and feed a sheet without reducing the productivity.

In order to solve the above problem, according to the present invention, there is provided a sheet feeding device which separates a sheet from a plurality of stacked sheets and feeds the sheet, the sheet feeding device including: a sheet stacking portion on which the sheets are stacked; an air blow portion which blows air to the sheets on the sheet stacking portion to blow up the sheets; a sheet feeding portion which sucks and conveys the topmost sheet of the sheets blown up by the air blow portion; and a separation rotating member which is rotatable upon abutting on a rear portion, in a feeding direction, of the sheets stacked on the sheet stacking portion, wherein the separation rotating member rotates in a direction which returns the sheet in synchronization with sheet feeding operation performed by the sheet feeding portion.

In the present invention, when a sheet feeding portion feeds one sheet but ends up feeding a plurality of sheets by failure, a separation rotating member arranged at a rear portion in a sheet feeding direction rotates to return multiple-fed sheets back in the direction opposite to the feeding direction. Therefore, multiple-feeding can be reliably prevented, and with the simple structure, the productivity in the sheet conveyance operation is not reduced.

Further features of the present invention will become apparent from the following description of exemplary embodiments with reference to the attached drawings.

BRIEF DESCRIPTION OF THE DRAWINGS

FIG. 8A is a diagram illustrating a table relating to pressing force of the rear-end separation roller onto a sheet. FIG. 8B is a diagram illustrating a table relating to driving velocity of the rear-end separation roller.

FIG. 16 is a diagram illustrating a table relating to the amount of movement of the rear-end separation roller according to the second embodiment.

DESCRIPTION OF THE EMBODIMENTS

Subsequently, exemplary embodiments for carrying out the present invention will be specifically described with reference to the drawings.

[First Embodiment]

Figure 1:
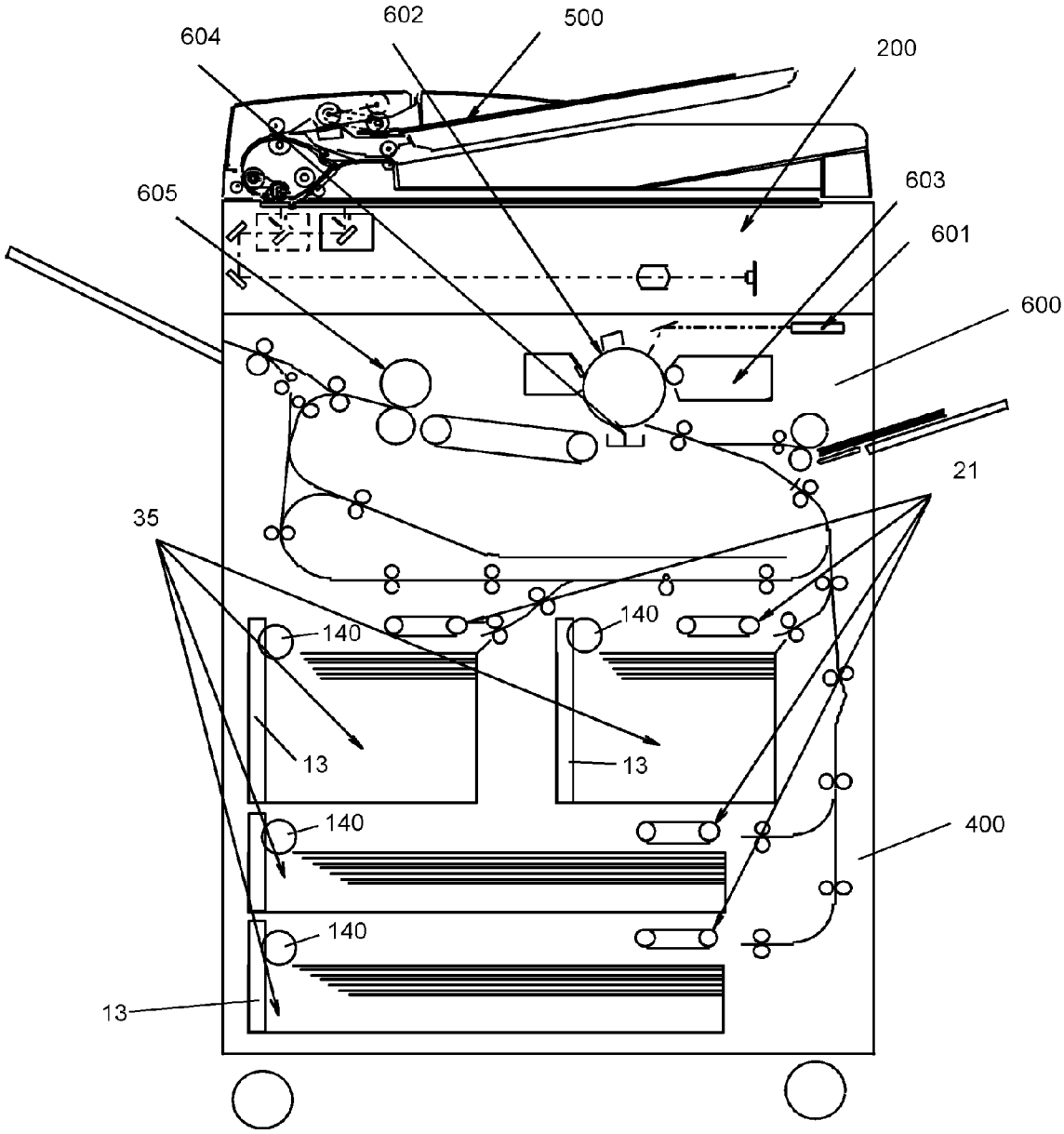
FIG. 1 is a schematic diagram illustrating an image forming apparatus according to an embodiment.

FIG. 1 is a schematic cross sectional diagram of an image forming apparatus having a sheet feeding device according to a first embodiment.

<Image Forming Apparatus>

First, an entire structure of the image forming apparatus according to the present embodiment will be described. The image forming apparatus according to the present embodiment has an image reading portion 200 arranged at the upper portion of the main body of the apparatus and an image forming portion 600 below the image reading portion 200. In addition, a sheet feeding device 400 for feeding sheets to the image forming portion 600 is arranged at the lower portion of the main body of the apparatus.

In the image reading portion 200, an auto original feeding portion 500 optically reads an original document automatically conveyed to a reading position, converts the read information into a digital signal, and transmits the digital signal to the image forming portion 600.

The image forming portion 600 causes a laser scanner unit 601 to emit laser light based on the read information, forms an electrostatic latent image onto a photosensitive drum 602, and causes a development device 603 to develop the electrostatic latent image with toner, thus visualizing the image.

In synchronization with the formation of the toner image, a sheet is fed from the sheet feeding device 400 to the image forming portion, and a transfer portion 604 transfers the toner image onto the fed sheet. Then, the sheet is conveyed to the fixing portion 605 to be heated and pressurized, so that the toner image is fixed onto the sheet. Thereafter, a pair of discharge rollers 606 discharges the sheet to a discharge portion.

The sheet feeding device 400 according to the present embodiment has a rear-end separation roller 140 arranged at the rear side of the sheet stacking portion so that the rear-end separation roller 140 abuts on the rear end of the upper portion of the stacked sheets, as described later. This rear-end separation roller 140 is configured to rotate in a direction for returning a sheet in synchronization with sheet feeding operation, so as to reliably separate a sheet from sheets and feed the separated sheet. The direction for returning the sheet means a direction opposite to the direction in which the sheet is fed upon separation.

<Sheet Feeding Device>

Subsequently, the sheet feeding device 400 feeding a plurality of stacked sheets to the image forming portion will be specifically described.

The sheet feeding device 400 according to the present embodiment is structured using an air sheet feeding method including the steps of blowing air to sheets, separating a sheet, and thereupon feeding the sheet.

Figure 2A:
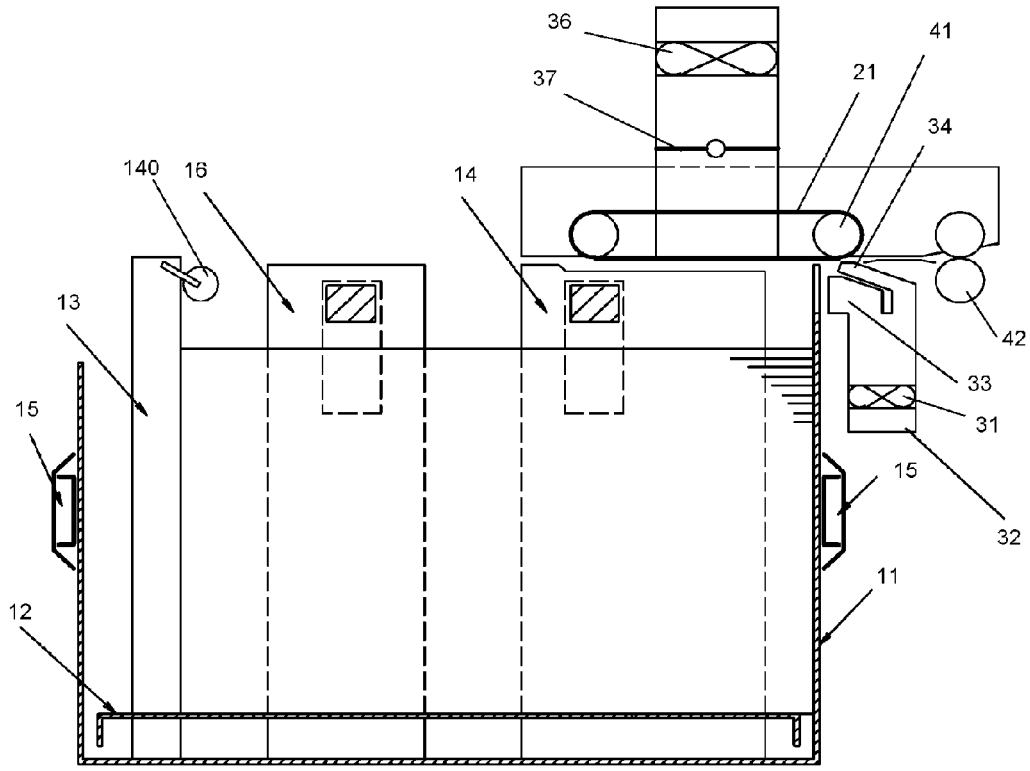
FIGS. 2A and 2B are explanatory diagrams illustrating sheet feeding operation according to an air sheet feeding method.

The air sheet feeding method will be specifically described. As shown in FIG. 2A, a sheet stacking portion 11 has a tray 12 on which a plurality of sheets are stacked, and can be pulled out of the main body of the apparatus along slide rails 15. In addition, a rear-end restricting plate 13, i.e., a rear-end restricting member, is arranged to restrict the upstream side in the feeding direction (rear side of sheets to be fed) of sheets stacked on this tray 12, and side-end restricting plates 14,16 are arranged to restrict a direction perpendicular to the sheet feeding direction (widthwise direction of sheet). The rear-end restricting plate 13 and the side-end restricting plates 14,16 are arranged to be movable so that the positions can be changed according to the size of sheet.

Figure 2B:
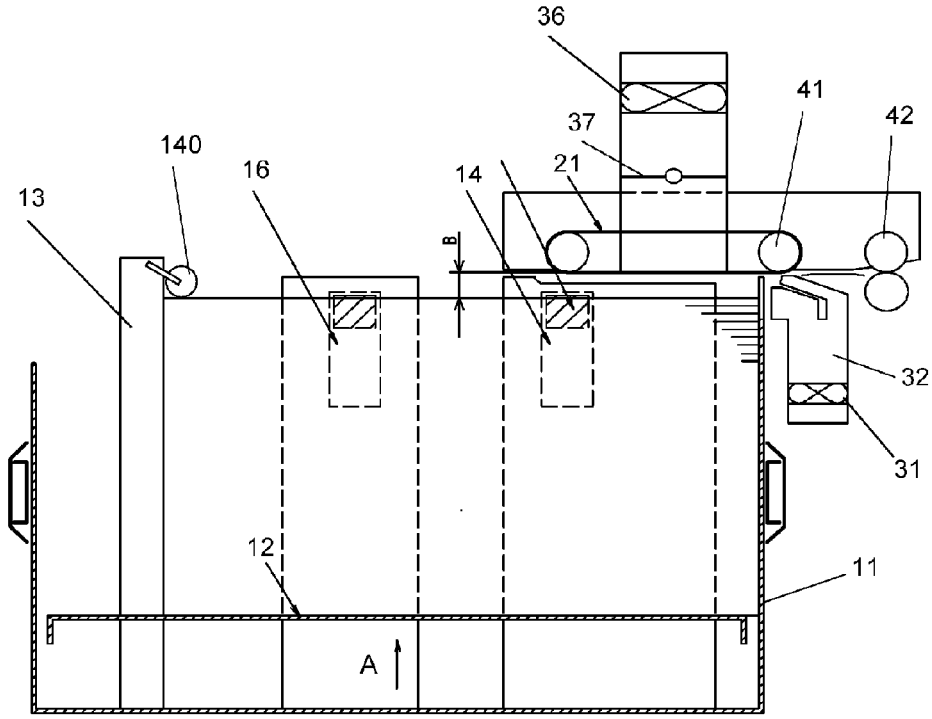

As shown in FIG. 2B, the user pulls out the sheet stacking portion 11 and sets sheets to store to a predetermined position of the sheet stacking portion 11. Thereupon, driving unit (not shown) begins to move the tray 12 upward in direction A in FIG. 2B. Then, the tray 12 stops at a position at which the topmost sheet and a suction conveyance belt 21 serving as a sheet feeding portion are spaced apart by a predetermined distance, so that the sheet stacking portion 11 is ready for a feeding signal.

Figure 3A:
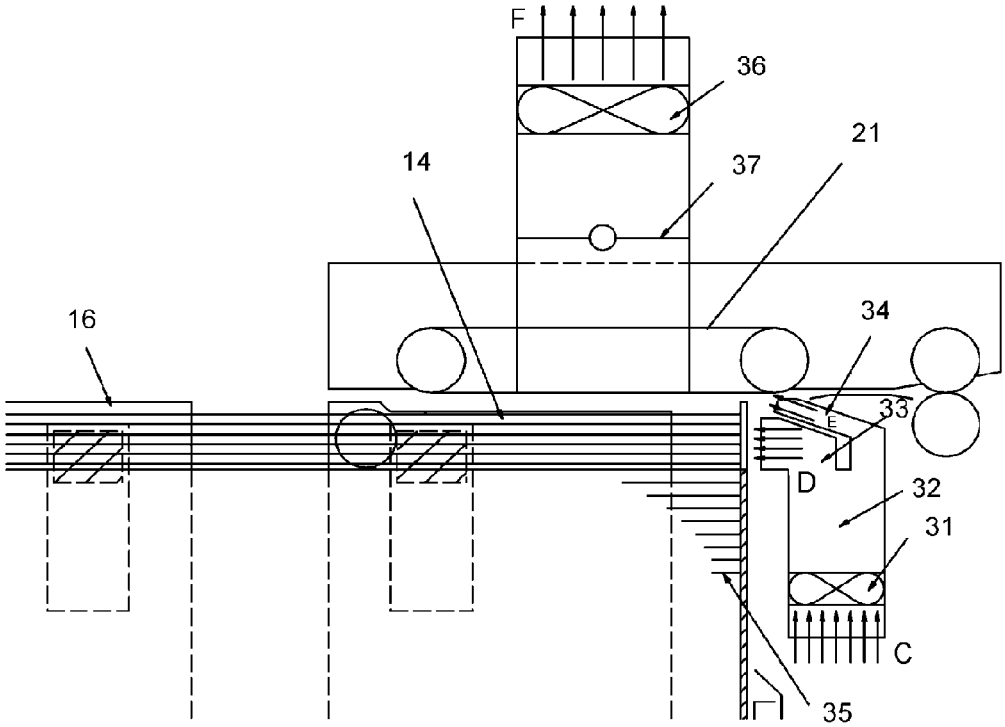
FIGS. 3A and 3B are explanatory diagrams illustrating sheet feeding operation according to the air sheet feeding method.

In FIG. 3A, when the feeding signal is detected, a loosening/separation fan 31 is activated to suck air into direction C of FIG. 3A. This air passes through a separation duct 32, and is blown to the side face of the upper portion of the stacked sheets from a loosening nozzle 33 as an air blow portion and a separation nozzle 34 in directions D and E, respectively, of FIG. 3A. Several sheets (35A) of the sheets 35 are blown up as shown in the figure. On the other hand, a suction fan 36 is activated to blow air in direction F of FIG. 3A. At this occasion, a suction shutter 37 is still closed.

Figure 3B:
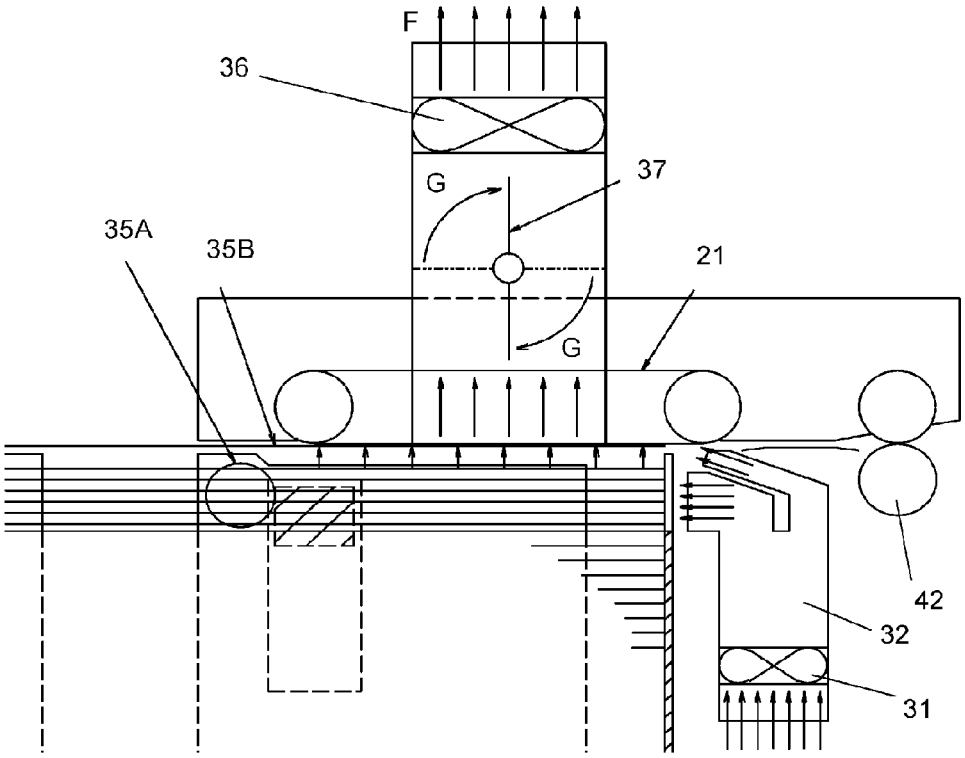

When a predetermined period of time passes since the feeding signal is detected, and the sheets 35A are blown up in a stable manner, the suction shutter 37 is rotated in direction G of FIG. 3B, as shown in FIG. 3B. This rotation of the suction shutter 37 generates suction force in direction H of FIG. 3B through suction holes (not shown) penetrating the conveyance belt 21, and the topmost sheet 35B is sucked by the suction force.

Figure 4:
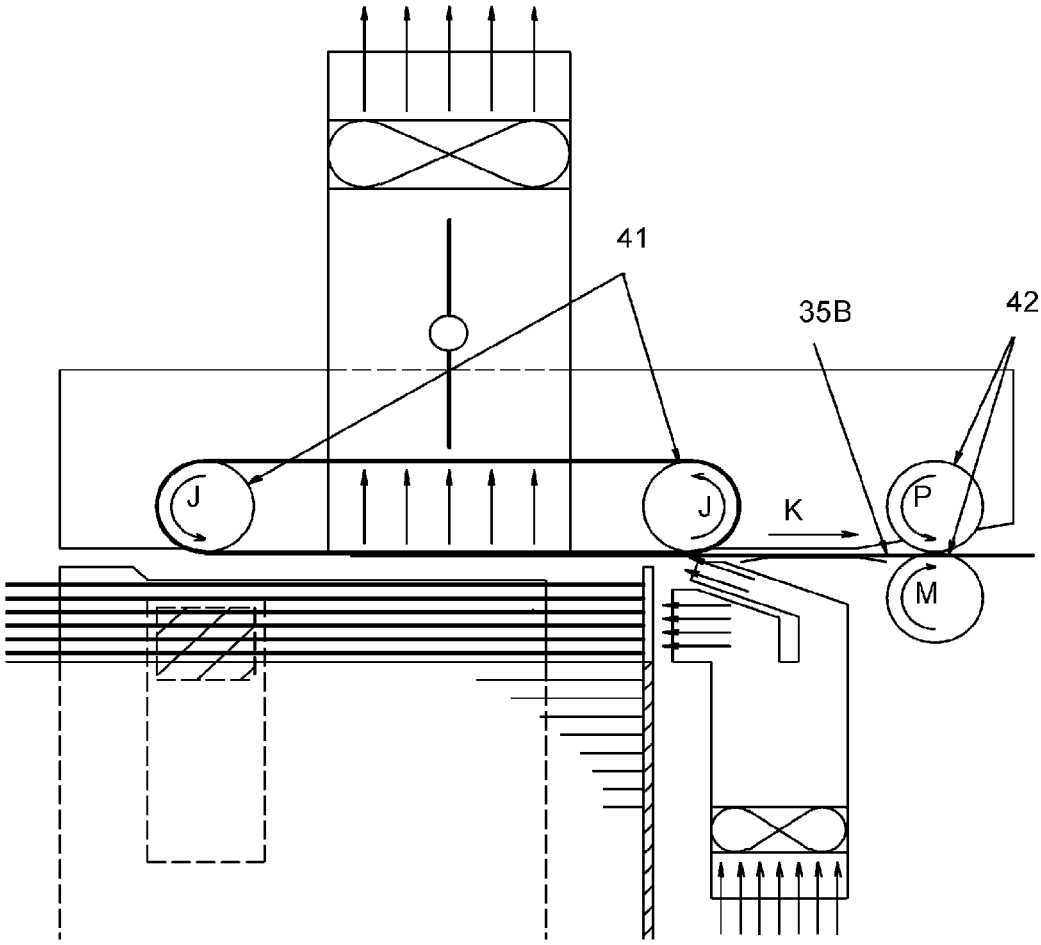
FIG. 4 is an explanatory diagram illustrating sheet feeding operation according to the air sheet feeding method.

Further, as shown in FIG. 4, the belt drive roller 41 is rotated in direction J of FIG. 4, so that the sheet 35B is sucked and conveyed in direction K of FIG. 4. Ultimately, the pair of extraction rollers 42 rotates in directions M and P of FIG. 4, so as to feed the sheet to the image forming portion.

(Separation Rotating Member)

The sheet feeding device according to the present embodiment is arranged with the rear-end separation roller 140 on the rear-end restricting plate 13. The rear-end separation roller 140 serves as a separation rotating member which can rotate upon abutting on the rear portion, in the feeding direction, of the sheets stacked on the sheet stacking portion 11. This rear-end separation roller 140 is configured to rotate in a direction for returning a sheet in synchronization with sheet feeding operation performed by the conveyance belt 21. The direction for returning the sheet means a direction opposite to the direction in which the sheet is fed upon separation.

The operation of the rear-end separation roller 140 will be described in relation to the above-described sheet feeding operation.

Figure 5A:
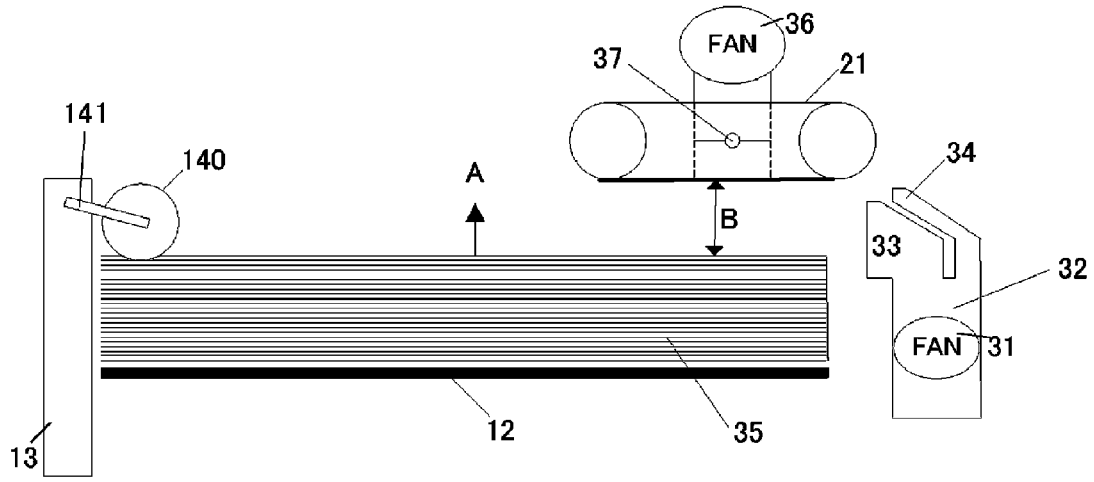
FIGS. 5A and 5B are explanatory diagrams illustrating sheet feeding operation with a rear-end separation roller.

As described above, the user pulls out the sheet stacking portion 11, sets sheets to the sheet stacking portion 11, and store storage unit at a predetermined position. At this occasion, driving unit (not shown) begins to move the tray 12 upward in direction A in FIG. 2B. Then, the tray 12 stops at a position at which the topmost sheet and the suction conveyance belt 21 are spaced apart by a distance B, so that the sheet stacking portion 11 is ready for a feeding signal. At this moment, the rear-end separation roller 140 abuts on the rear portion, in the feeding direction, of the sheets stacked on the sheet stacking portion 11 (FIG. 5A).

Figure 5B:
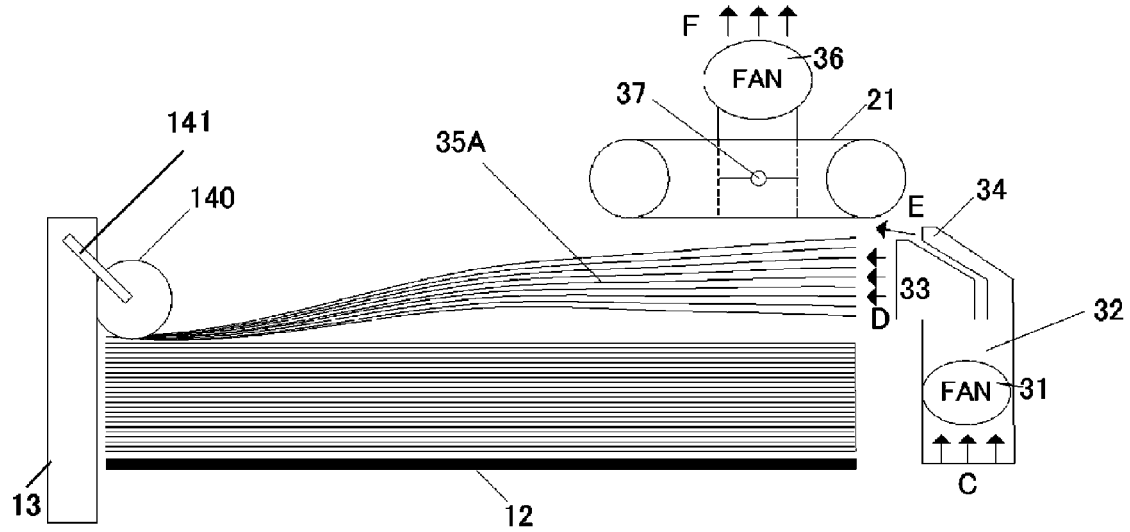
Figure 6A:
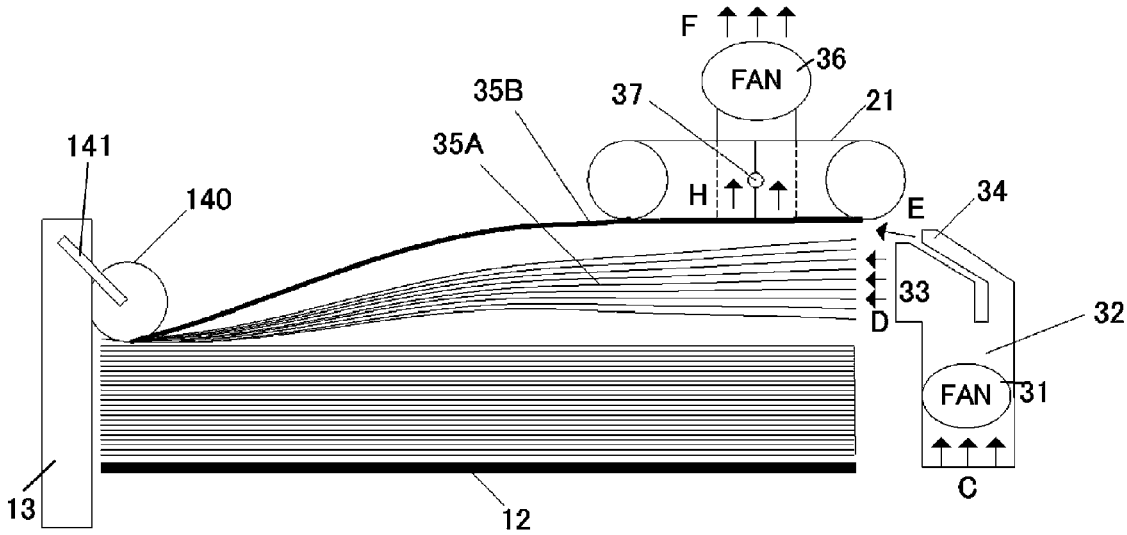
FIGS. 6A and 6B are explanatory diagrams illustrating sheet feeding operation with the rear-end separation roller.

When the sheet feeding signal is detected, the loosening/separation fan 31 is activated to blow air to the stacked sheets from the loosening nozzle 33 and the separation nozzle 34 in directions D and E, respectively, of FIG. 3A. Several sheets (35A) of the sheets 35 are blown up, and the suction shutter 37 is rotated, so that the topmost sheet 35B is sucked to the conveyance belt 21 (FIG. 5B and FIG. 6A).

Figure 6B:
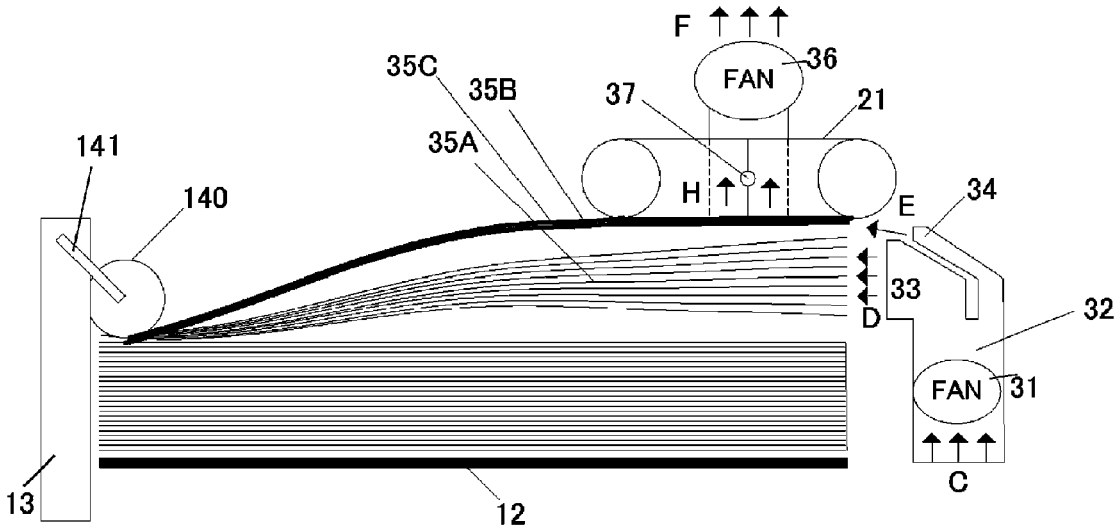

At this occasion, as shown in FIG. 6B, not only the topmost sheet 35B but also a sheet 35C below the topmost sheet 35B may be sucked to the conveyance belt 21. This is considered to occur when (1) static electricity occurs between sheets according to the use environment, (2) water generates suction force between sheets according to the use environment, and (3) burr (physical contact) is made between sheets. If the sheets are sucked and conveyed by the conveyance belt 21 in this state, multi-feeding occurs.

Figure 7:
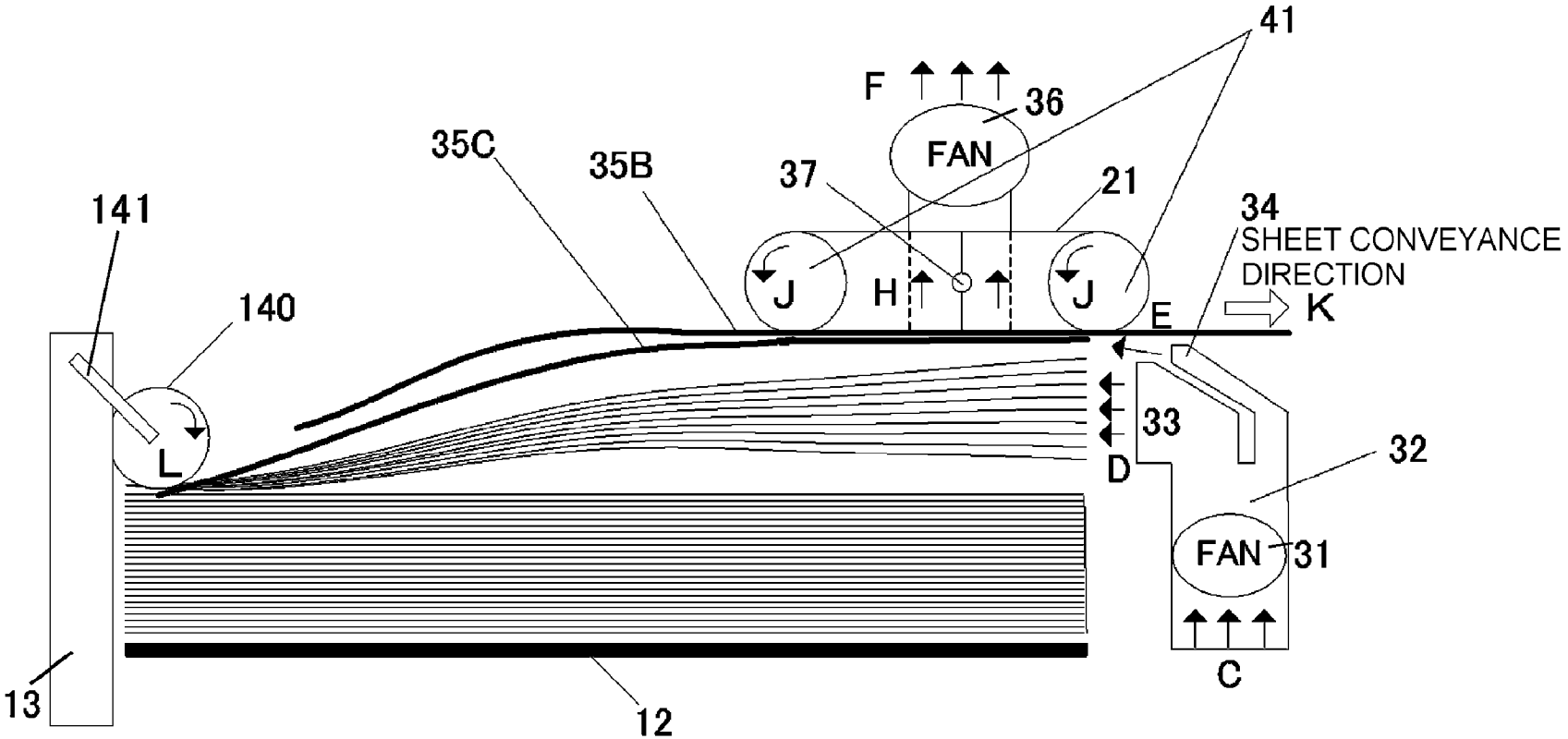
FIG. 7 is an explanatory diagram illustrating sheet feeding operation with the rear-end separation roller.

To solve this problem, in the present embodiment, the rear-end separation roller 140 is rotated in a direction opposite to the sheet conveyance direction (direction L of FIG. 7) at the same time as the belt drive roller 41 is rotated in direction J of FIG. 7, as shown in FIG. 7. As a result of this operation, the rear end of the sheet (35C) other than the sheet 35B to be fed is pulled back so as to prevent multi-feeding of sheets.

Then, the sheet 35B is conveyed in direction K of FIG. 7. Ultimately, the pair of extraction rollers 42, not shown, rotates to feed the sheet 35B to a subsequent conveyance path.

(Pressing Force of Separation Rotating Member)

The sheet feeding device according to the present embodiment has a velocity switching portion and a pressing force switching portion for changing the pressing force applied to sheets by the rear-end separation roller 140 according to the basis weight of sheet, the environment of the apparatus, and the type of sheet (in the present embodiment, whether there is coating or not).

As shown in FIG. 7, the pressing force switching portion is structured such that an arm 141 supporting the rear-end separation roller 140 is pivotably attached to the rear-end restricting plate 13, and the arm 141 is urged in a clockwise direction of FIG. 7 by a spring, not shown. A motor, not shown, is activated, and the amount of rotation of the motor is adjusted, so that the urging force of the spring can be changed stepwise. Accordingly, by activating the motor, the pressing force applied to the sheet by the rear-end separation roller 140 can be changed stepwise. Alternatively, instead of the motor, a solenoid may be used as the structure for changing the pressing force.

The pressing force is set to be larger when the basis weight of the sheet to be fed is large than when it is small. This is because a large and thick sheet having a large basis weight of sheet requires a large returning force of the rear-end separation roller 140 in order to prevent multi-feeding, as compared with a small and thin sheet.

In addition, in the present embodiment, the pressing force is set to be larger when the environment of the apparatus is hot and humid than when it is cold and dry. This is because multi-feeding of sheet is more likely to occur under hot and humid environment than cold and dry environment. In order to prevent the multi-feeding under hot and humid environment, the returning force of the rear-end separation roller 140 needs to be large.

Further, in the present embodiment, the pressing force for a coated sheet is set to be larger than the pressing force for a non-coated sheet. This is because the coated sheets are more likely to attach to each other than the non-coated sheet, and accordingly the returning force of the rear-end separation roller 140 needs to be larger in order to prevent multi-feeding.

In the present embodiment, the sheet pressing force applied by the rear-end separation roller 140 is set based on a setting table shown in FIG. 8A. More specifically, in FIG. 5A, the pressing force of the rear-end separation roller 140 is defined to be zero when the tray 12 stops at a position where the conveyance belt 21 and the upper surface of the sheets are spaced apart by the distance B. In addition, the control portion controls the pressing force switching portion so as to set the force applied onto the upper surface of the sheets by the rear-end separation roller 140 based on the setting table of FIG. 8A according to the environment in which the apparatus is installed, the basis weight of sheet, and whether the sheet is a coated sheet or not.

The unit for determining whether the sheet is a coated sheet or not may be based on an input received from input unit (not shown) such as an operation panel, or may include detection unit for detecting whether the sheet is a coated sheet or not by detecting the gloss of the sheet.

The environment in which the apparatus is installed is determined using temperature/humidity detection unit arranged in the apparatus for detecting the temperature and the humidity.

The basis weight of sheet can be detected based on the size of input sheet set and the type of sheet.

(Rotational Velocity of Separation Rotating Member)

Further, when the rear-end separation roller 140 rotates in the sheet feeding device according to the present embodiment, a velocity difference is ensured between a rotational velocity V1 of the rear-end separation roller 140 and a rotational velocity VO of the belt drive roller 41, i.e., sheet feeding velocity. As a result, the rear-end separation roller 140 has a power to prevent multi-feeding. For this, the velocity switching portion is arranged to switch the rotational velocity of the rear-end separation roller 140. The velocity switching portion according to the present embodiment is configured such that the control portion switches the velocity of the rear-end separation roller 140 according to the basis weight of sheet, the environment of the apparatus, and the type of sheet (in the present embodiment, whether the sheet is coated or not).

Specifically, the rotational velocity V1 of the rear-end separation roller 140 is set to be a little bit slower than the rotational velocity VO of the belt drive roller 41, so as to have a relative velocity difference.

Further, the relative velocity difference therebetween is set to be smaller when the basis weight of the sheet to be fed is small than when it is large. The relative velocity difference is set to be smaller when the apparatus is installed in hot and humid environment than when it is installed in cold and dry environment. The relative velocity difference is set to be smaller when the sheet is a coated sheet than when it is a non-coated sheet.

In the present embodiment, the rotational velocity V1 of the rear-end separation roller 140 with respect to the rotational velocity VO of the belt drive roller 41 is set based on the setting table shown in FIG. 8B according to the basis weight of sheet, the environment of the apparatus, and whether the sheet is coated or not.

As described above, multi-feeding of sheets can be effectively prevented by changing not only the pressing force applied onto the sheet by the rear-end separation roller 140 but also the rotational velocity of the rear-end separation roller 140 according to the sheet to be fed and the environment of the apparatus.

The setting table of FIG. 8A and FIG. 8B includes only the basis weight of sheet, whether there is coating or not, and the environment in which the apparatus is installed. In addition, for example, the table may be prepared that also includes the suction force of the suction fan 36 and the size of sheet so as to further divide cases, thus enabling more accurate separation and feeding operation.

(Control Portion)

Subsequently, the control structure for driving and controlling the rear-end separation roller 140 as described above will be described.

Figure 9:
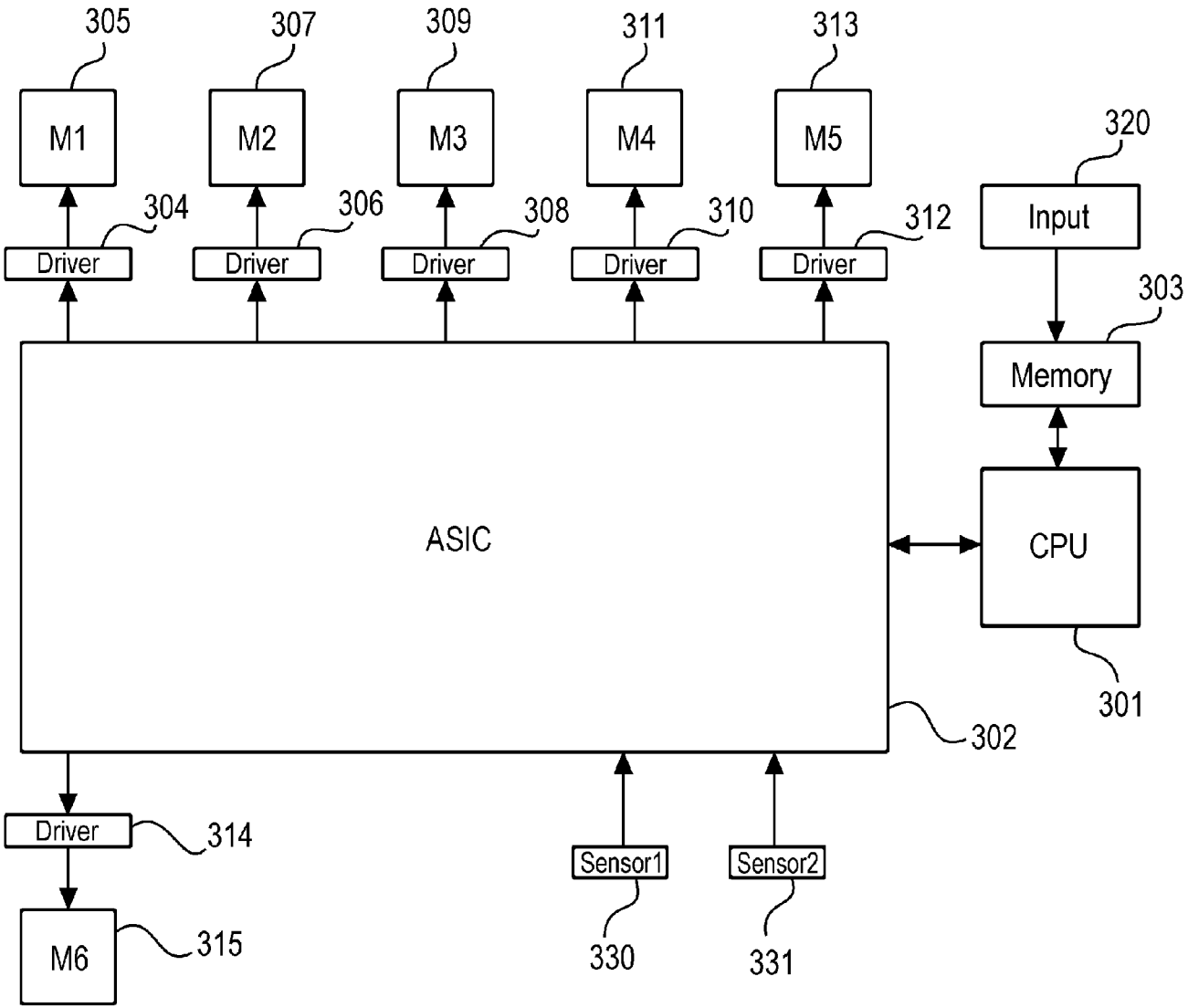
FIG. 9 is a block diagram describing a circuit configuration of a sheet feeding device.

FIG. 9 is a block diagram describing a configuration of a circuit of the sheet feeding device according to the present embodiment. A CPU 301 controlling the sheet feeding device is connected to a dedicated ASIC 302 for driving various kinds of loads of the sheet feeding device such as a motor and to a memory 303. The memory 303 stores the table, as shown in FIG. 8A, based on which the pressing force of the rear-end separation roller 140 is changed according to the environment and the material of the sheet. In addition, the memory 303 stores the table, as shown in FIG. 8B, based on which the driving velocity of the rear-end separation roller 140 is changed according to the environment of the apparatus and the material of the sheet.

The ASIC 302 gives a driving start instruction to a drive circuit driving each load of the sheet feeding device. A lifter motor 305 controls lifting and lowering of the tray 12. A driver 304 controls the lifter motor. A suction shutter driving motor 307 controls the suction shutter 37. A driver 306 controls the suction shutter driving motor. A belt driving motor 309 controls the rotation of the conveyance belt 21. A belt driving motor driver 308 controls the belt driving motor. A rear-end separation motor 311 drives the rear-end separation roller 140. A rear-end separation motor driver 310 controls the rear-end separation motor. A pressing force control motor 313 controls the pressing force of the rear-end separation roller 140. A pressing force control motor driver 312 controls the pressing force control motor. An extraction motor 314 drives the pair of extraction rollers 42. An extraction motor driver 315 controls the extraction motor.

An input portion 320 is used to input information such as the size of sheet and the material. A sensor 330 detects the temperature of the environment in which the apparatus is installed. A sensor 331 detects the humidity of the environment in which the apparatus is installed.

When the sheet feeding device according to the present embodiment receives a sheet feeding start signal, the sheet feeding device causes the ASIC 302 to control the rear-end separation motor 311 and the pressing force control motor 313, based on the table stored in the memory 303 according to information provided by the input portion 320 and the temperature/humidity sensors 330, 331 of the environment in which the apparatus is installed. The control timing and the rotational direction of each motor are also controlled by the ASIC 302.

(Timing Chart)

Figure 10:
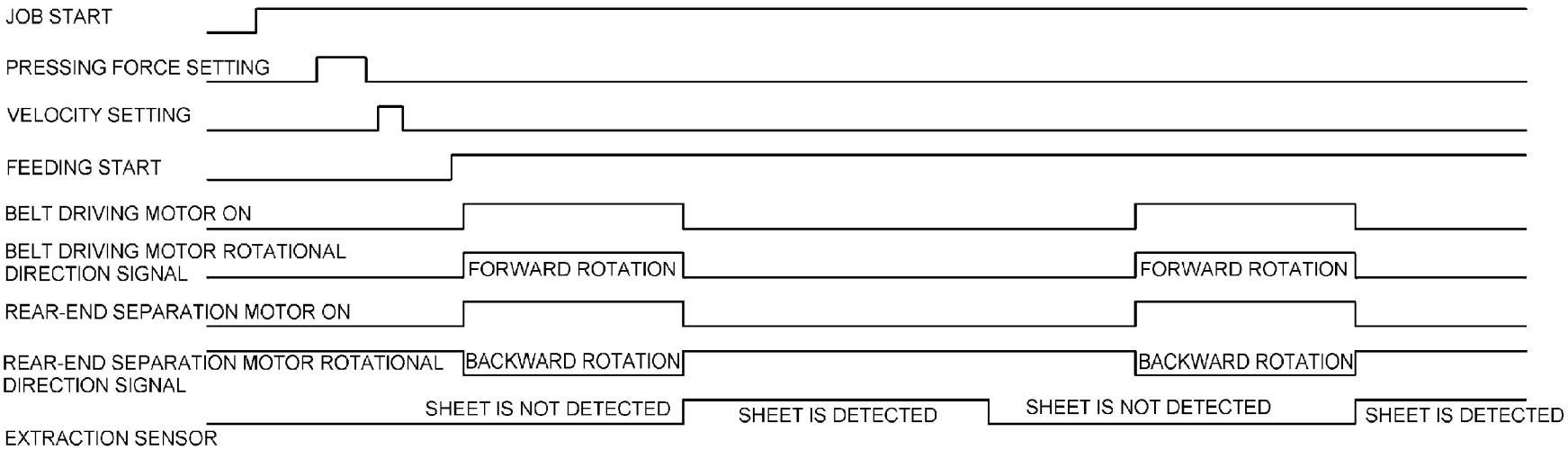
FIG. 10 illustrates a timing chart of the sheet feeding device.

Subsequently, timing of driving the rear-end separation roller 140 according to the present embodiment will be described using the timing chart of FIG. 10.

The image forming apparatus according to the present embodiment is arranged with the temperature sensor 330 and the humidity sensor 331 as shown in FIG. 9, which keep on detecting the environment of the apparatus. When the sheet feeding conditions are set, and a job start signal is input, the job starts. In order to start the job, the image forming apparatus prepares for sheet feeding operation. During the preparation for feeding operation, first, the pressing force of the rear-end separation roller 140 is set, and then the driving velocity of the rear-end separation roller 140 is set based on the above-described table. Alternatively, the driving velocity of the rear-end separation roller may be set first before the pressing force of the rear-end separation roller is set.

When the preparation for sheet feeding operation is finished, the sheet feeding operation starts. The belt driving motor 309 and the rear-end separation motor 311 are controlled so that the belt driving motor 309 is rotated in the forward direction and at the same time the rear-end separation motor 311 is rotated in the backward direction. The forward direction of the rotational direction of motor is the sheet feeding direction (the direction indicated by arrow K in FIG. 7), and the backward direction is the return direction of sheet.

When an extraction sensor (not shown) is activated, the belt driving motor 309 and the rear-end separation motor 311 are controlled so that both of them stops at a time. Alternatively, the rear-end separation motor 311 may be controlled to stop before the belt driving motor 309 stops. Unless the job is finished, the job is controlled to be continuously processed.

(Flowchart)

Figure 11:
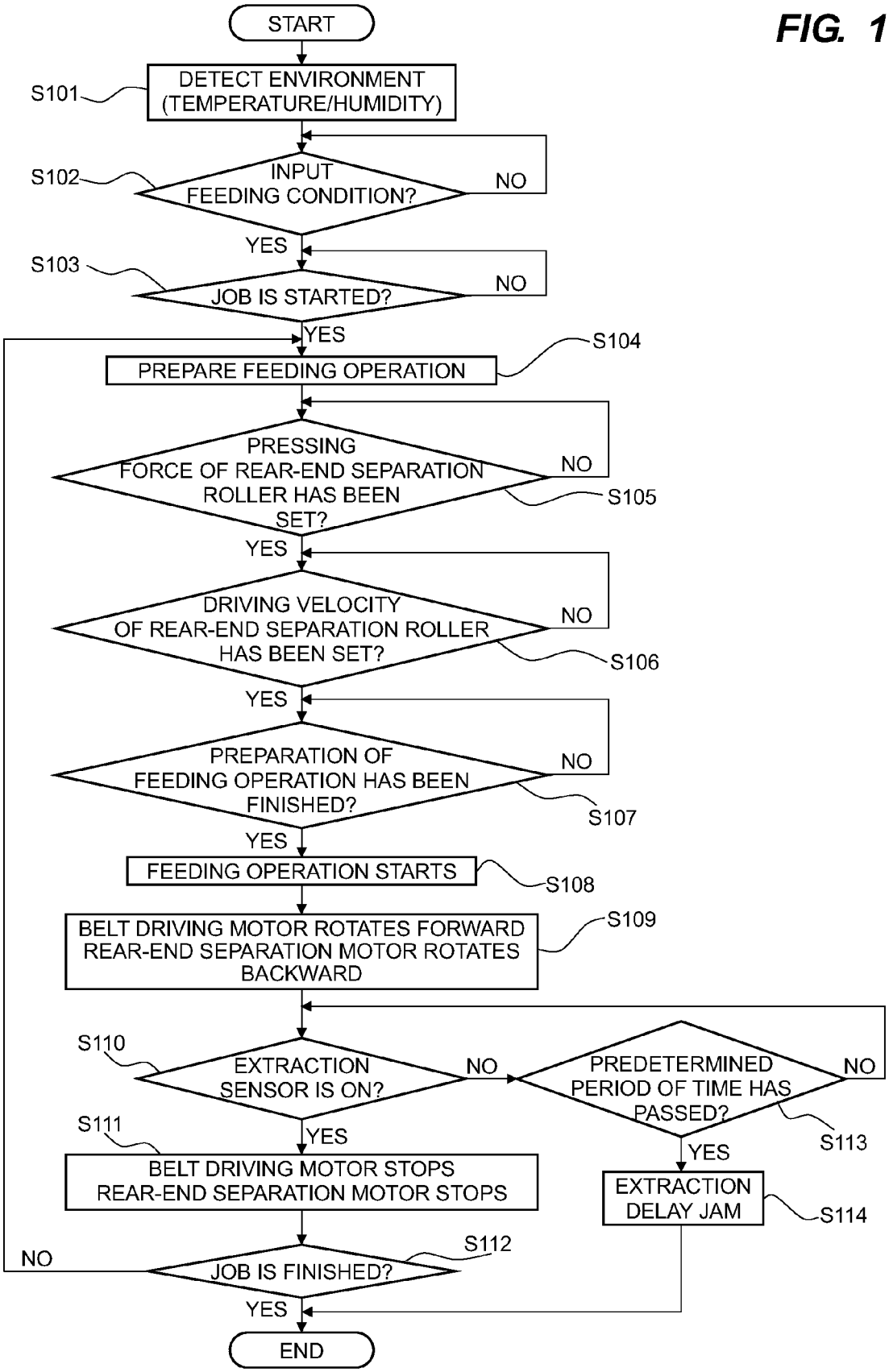
FIG. 11 illustrates a flowchart of operation of the sheet feeding device.

Subsequently, the sheet feeding procedure of the sheet feeding device according to the present embodiment will be described using the flowchart of FIG. 11.

As described above, the temperature sensor 330 and the humidity sensor 331 keep on detecting the state of the apparatus (S101). In S102, the sheet feeding conditions are set using the input portion 320, the program proceeds to step S103. When a job start signal is received in S103, the job starts. In order to carry out the job, the preparation for sheet feeding operation is controlled to be performed (S104).

During the preparation for feeding operation, first, the pressing force control motor driver 312 (see FIG. 9) is caused to activate the pressing force control motor 313 so as to set the pressing force of the rear-end separation roller 140 (S105). Subsequently, the driving velocity of the rear-end separation roller 140 is set based on the above-described table of the memory 303 (S106).

When the preparation for sheet feeding operation is finished in S107, the sheet feeding operation starts (S108). In S109, the belt driving motor driver 308 (see FIG. 9) is caused to rotate the belt driving motor 309 in the forward direction and the rear-end separation motor 311 in the backward direction at a time.

When the extraction sensor (not shown) is activated in S110, the belt driving motor 309 and the rear-end separation motor 311 stops at a time. When the job is finished in S112, the sheet feeding operation is not performed any more. Alternatively, when the job is not finished in S112, the program proceeds to S104 so as to perform the preparation for sheet feeding operation, and continues the job again. When the extraction sensor does not detect any sheet even after a predetermined period of time passes in S113, the program proceeds to S114, and the job is terminated with an extraction delay jam.

[Second Embodiment]

Subsequently, a sheet feeding device according to a second embodiment will be described. The basic structure of the apparatus according to the present embodiment is the same as that of the above-described previous embodiment. Accordingly redundant description thereabout is omitted. In the below explanation, significant features of the present embodiment will be described. Elements having the same functions as those of the above-described previous embodiment are denoted with the same reference numerals.

In the sheet feeding device according to the present embodiment, the sheets are loosened by the rear-end separation roller 140 before the sheets are fed by the conveyance belt 21, so that the sheets can be easily separated. The operation of the rear-end separation roller 140 according to the present embodiment will be hereinafter described in relation to the sheet feeding operation.

Figure 12A:
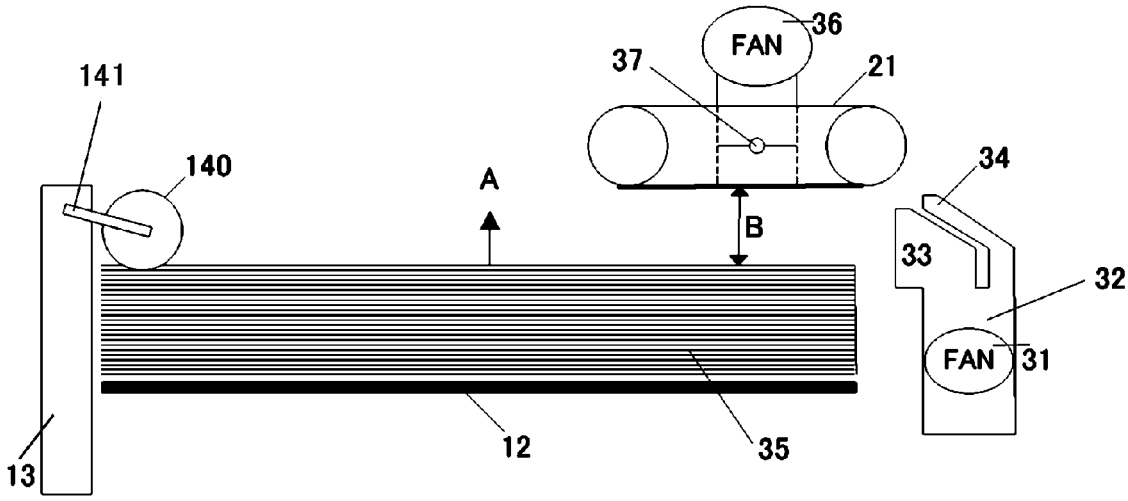
FIGS. 12A and 12B are explanatory diagrams illustrating sheet feeding operation with a rear-end separation roller according to a second embodiment.

As described in the previous embodiment, the user pulls out the sheet stacking portion, sets sheets to the sheet stacking portion, and store storage unit at a predetermined position. At this occasion, driving unit (not shown) begins to move the tray 12 upward in direction A in FIG. 12B. Then, the tray 12 stops at a position at which the topmost sheet and the suction conveyance belt 21 are spaced apart by the distance B, so that the sheet stacking portion 11 is ready for a feeding signal. At this moment, the rear-end separation roller 140 abuts to the rear portion, in the feeding direction, of the sheets stacked on the sheet stacking portion 11 (FIG. 12A).

Figure 12B:
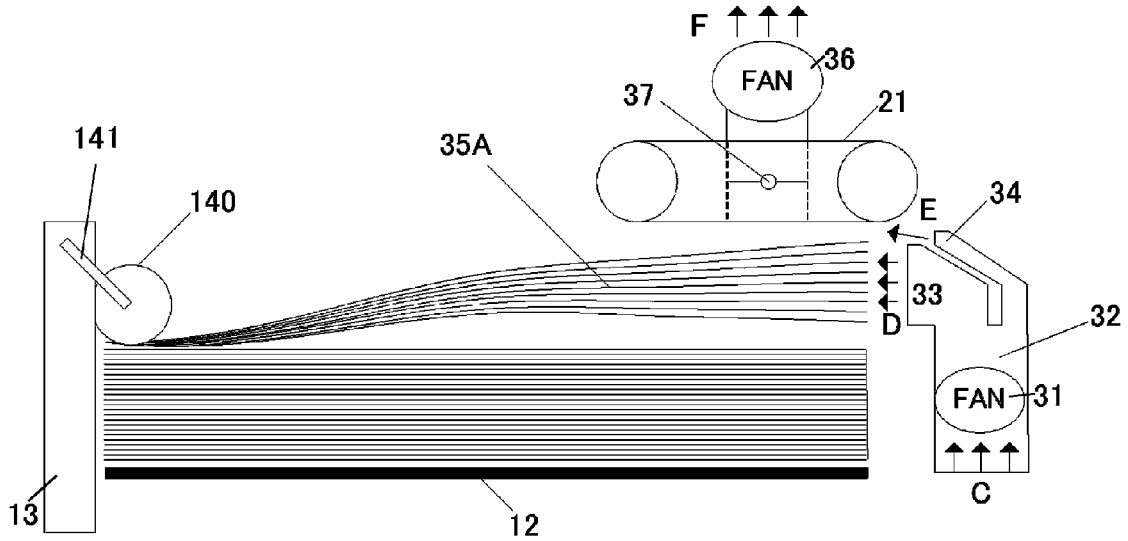

When the sheet feeding signal is detected, the loosening/separation fan 31 is activated to blow air to the stacked sheets from the loosening nozzle 33 as an air blow portion and the separation nozzle 34 in directions D and E, respectively, of FIG. 12B. Several sheets (35A) of the sheets 35 are blown up. At this occasion, the suction shutter 37 is still closed (FIG. 12B).

Figure 13A:
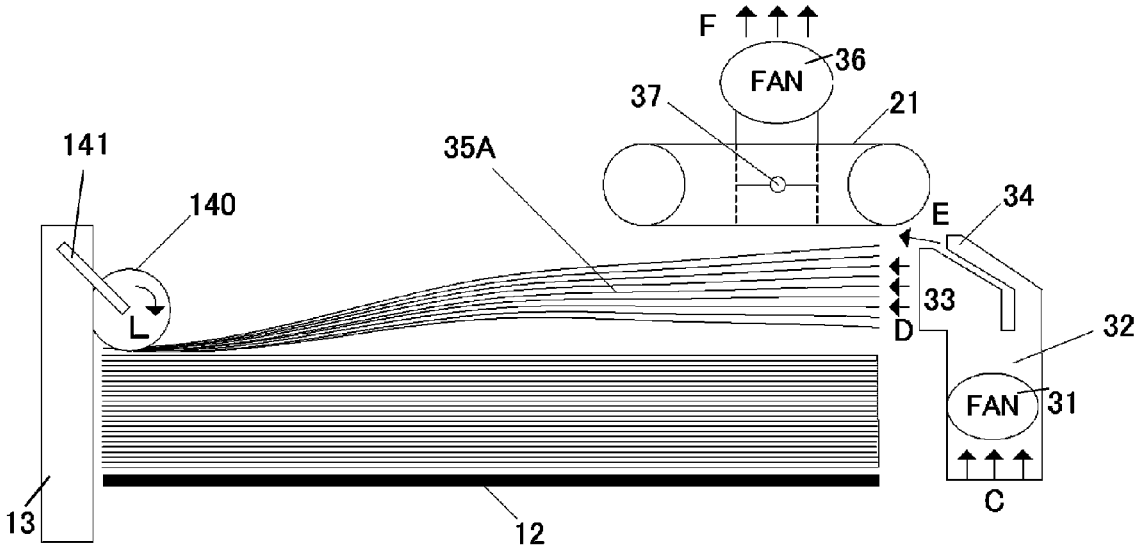
FIGS. 13A and 13B are explanatory diagrams illustrating sheet feeding operation with the rear-end separation roller according to the second embodiment.

While the suction shutter 37 is still closed, the rear-end separation roller 140 is activated by a predetermined amount in the direction indicated by arrow L (the direction for returning the sheet) (FIG. 13A). In this way, at the rear portion of the sheet, the rear-end separation roller 140 is rotated backward by a predetermined amount, so as to alleviate the sticking between the topmost sheet and the sheet below the topmost sheet.

Figure 13B:
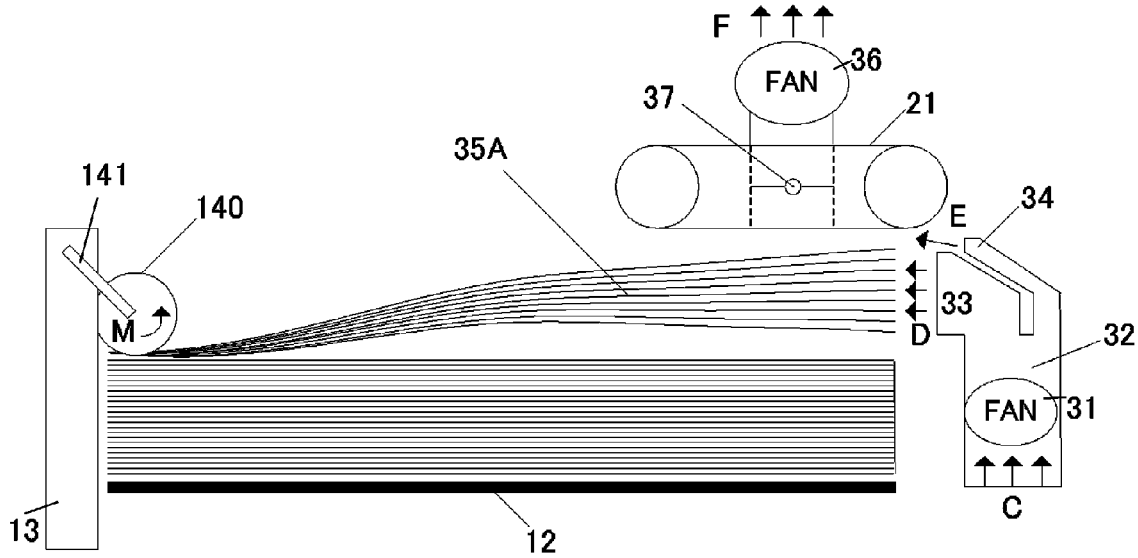

Further, the rear-end separation roller 140 is controlled to operate again in the direction M (the direction opposite to the direction L) by the same amount as that of the movement in the direction L (FIG. 13B). This operation allows further alleviating the sticking between the sheets.

Figure 14A:
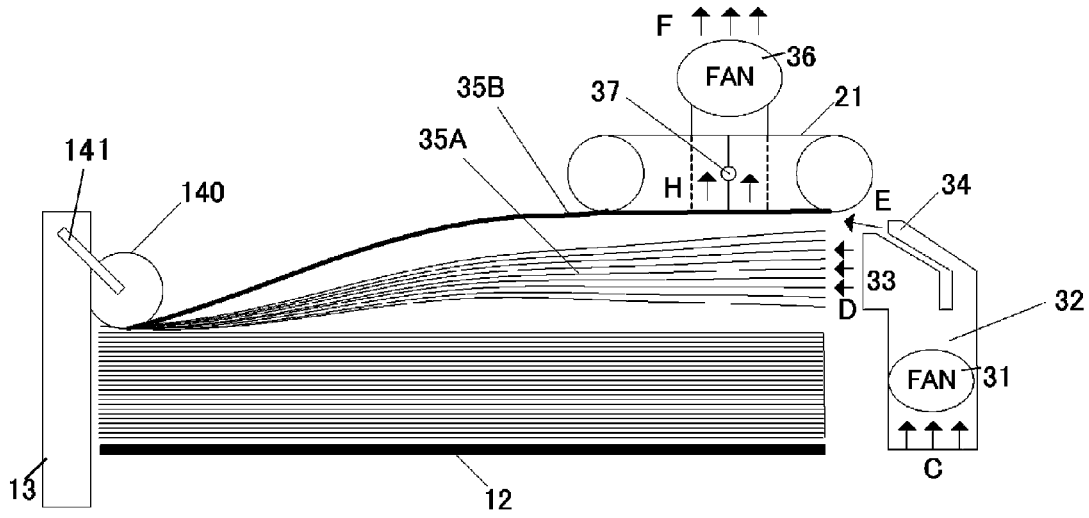
FIGS. 14A and 14B are explanatory diagrams illustrating sheet feeding operation with the rear-end separation roller according to the second embodiment.

Then, in FIG. 14A, when a predetermined period of time passes since the feeding signal is detected, and the sheet 35A is blown up in a stable manner, the suction shutter 37 is rotated, as shown in FIG. 14A. With this rotation, the topmost sheet 35B is sucked to the conveyance belt 21.

Figure 14B:
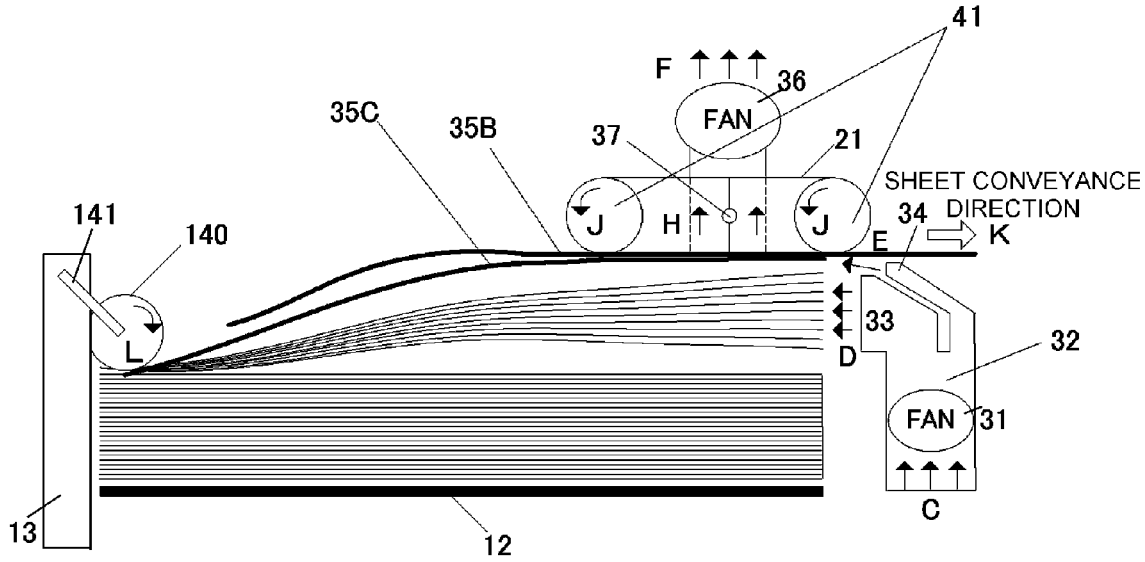

Ultimately, in FIG. 14B, the belt drive roller 41 is rotated in the direction J of FIG. 14B, and at the same time, the rear-end separation roller 140 is rotated in the direction opposite to the sheet conveyance direction (the direction L of FIG. 14B). As a result, the rear end of the sheet (35C) other than the sheet 35B to be conveyed is pulled back so as to prevent multi-feeding of sheets. Then, the sheet 35B is conveyed in the direction K of FIG. 14B, and ultimately, the pair of extraction rollers, not shown, rotate so as to feed the sheet to a subsequent conveyance path.

Figure 15:
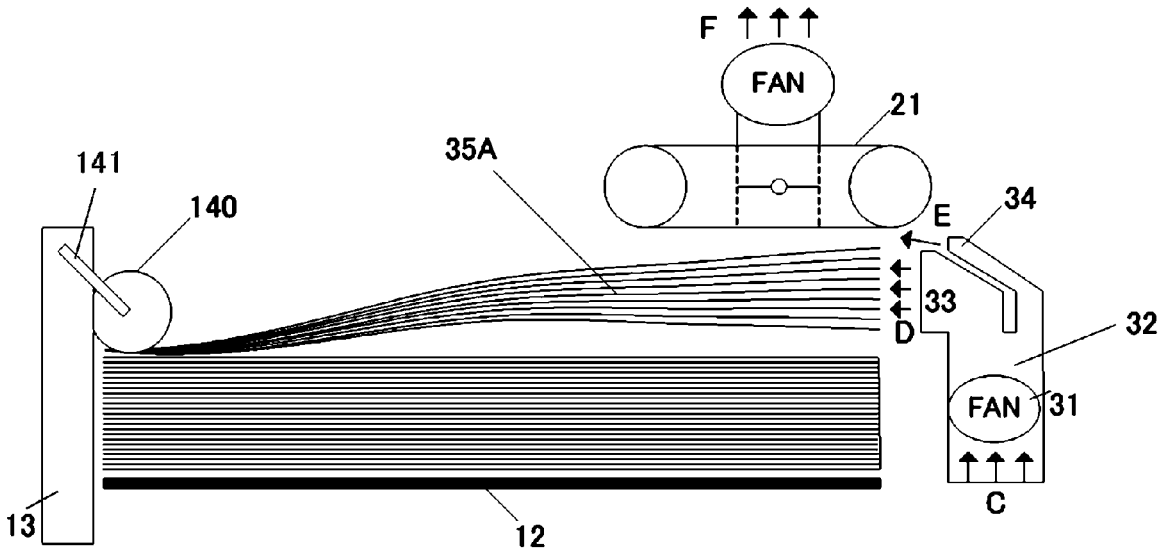
FIG. 15 is an explanatory diagram illustrating sheet feeding operation with the rear-end separation roller according to the second embodiment.

When the leading edge of the sheet 35B reaches the pair of extraction rollers, not shown, the suction shutter 37 is controlled to close (FIG. 15).

The amount of rotation (the amount of movement) of the rear-end separation roller 140 before the sheet feeding operation is set according to the basis weight of sheet, the environment of the apparatus, and the type of sheet (in the present embodiment, whether the sheet is coated or not)).

More specifically, the amount of movement is set to be larger when the basis weight of the sheet to be fed is small than when it is large.

In the present embodiment, the amount of movement is set to be larger when the apparatus is in cold and dry or hot and humid environment, as compared with the case where the apparatus is in normal environment (for example, a temperature T and a humidity H satisfies the following expression: 10 degrees Celsius<temperature T≦30 degrees Celsius and 30%<humidity H≦75%).

Further, in the present embodiment, the amount of movement is set to be larger when the sheet is a coated sheet than when the sheet is a non-coated sheet.

In other words, when it is necessary to greatly loosen the sheets, the amount of movement of the rear-end separation roller 140 is increased. Therefore, multi-feeding of sheets effectively eliminated.

In the present embodiment, the amount of movement of the belt drive roller 41 is set based on the setting table shown in FIG. 16 according to the basis weight of sheet, the environment of the apparatus, and whether the sheet is coated or not.

As described above, multi-feeding of sheets can be effectively prevented by changing the amount of rotation of the rear-end separation roller 140 according to the sheet to be fed and the environment of the apparatus.

(Timing Chart)

Figure 17:
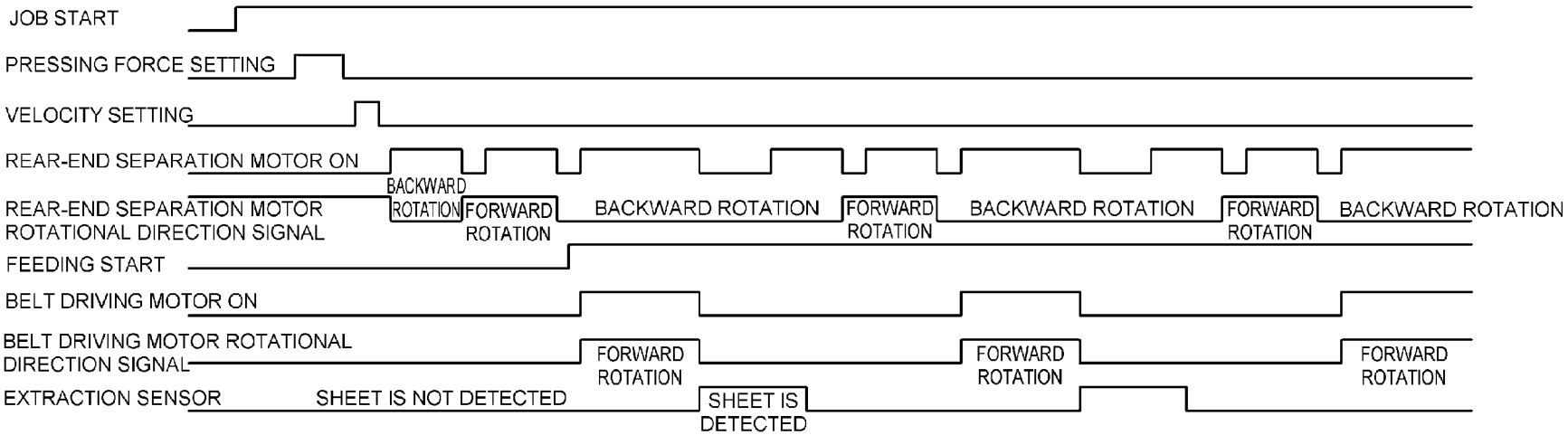
FIG. 17 illustrates a timing chart of a sheet feeding device according to the second embodiment.

Subsequently, timing of driving the rear-end separation roller 140 according to the present embodiment will be described using the timing chart of FIG. 17.

When the sheet feeding conditions are set, and a job start signal is input, the job starts. The pressing force of the rear-end separation roller 140 described in the first embodiment is set. Subsequently, the driving velocity of the rear-end separation roller is set based on the table described in the first embodiment.

Thereafter, the rear-end separation roller 140 is driven backward by a predetermined amount based on the table shown in FIG. 16. Subsequently, the rear-end separation roller 140 is driven forward by the same amount. In this way, the sheet to be fed is once warped, so that the sticking between sheets can be alleviated.

Thereafter the sheet is fed according to the procedure described in the first embodiment.

(Flowchart)

Figure 18:
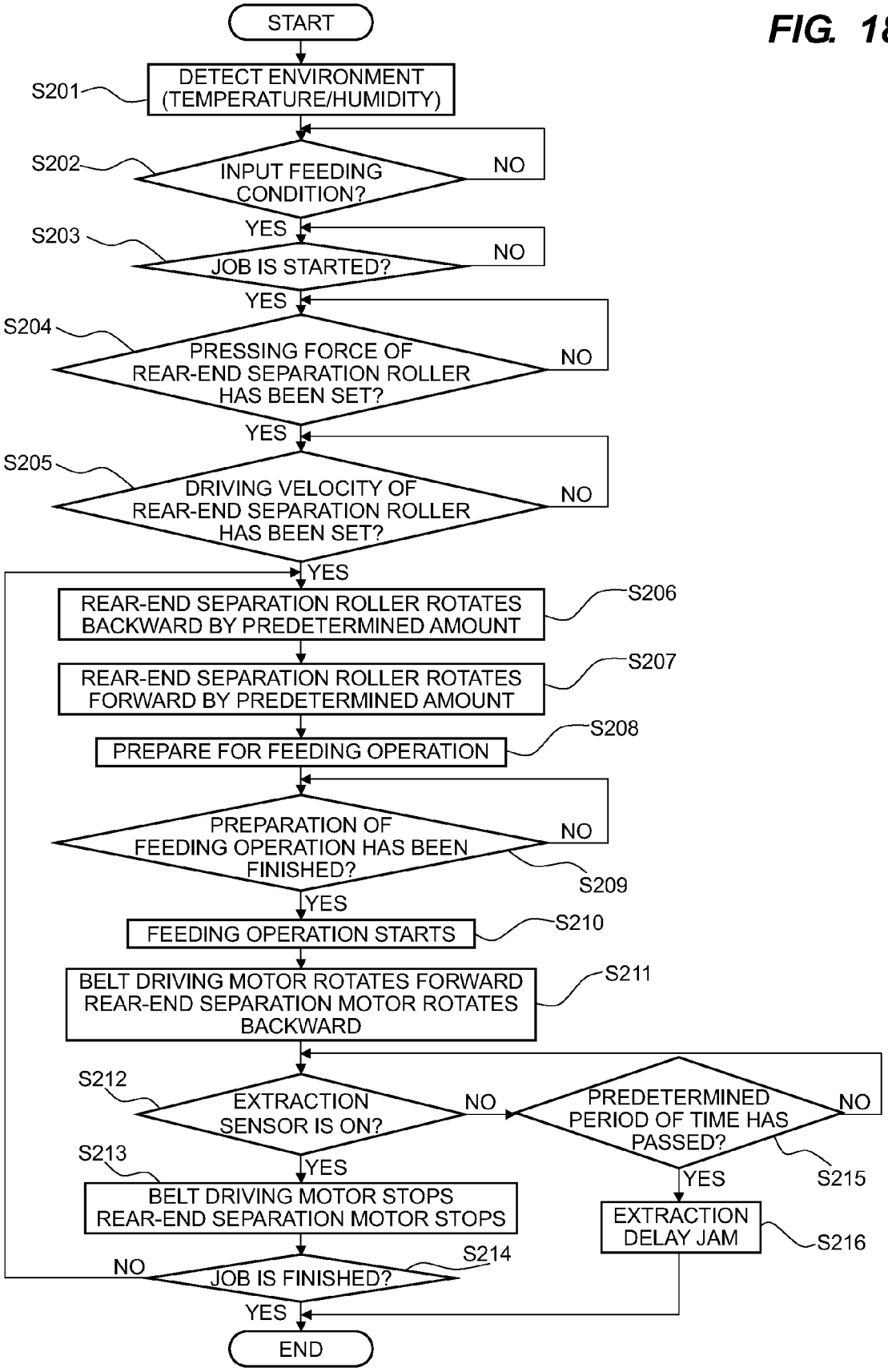
FIG. 18 illustrates a flowchart of operation of the sheet feeding device according to the second embodiment.

Subsequently, the sheet feeding procedure of the sheet feeding device according to the present embodiment will be described using the flowchart of FIG. 18.

In the image forming apparatus, the temperature sensor 330 and the humidity sensor 331 keep on detecting the environment of the apparatus (S201). When the sheet feeding conditions are set in S202, the program proceeds to S203. When the job start signal is received in S203, the job starts. Before the preparation for sheet feeding operation, first, the pressing force of the rear-end separation roller 140 is set (S204), and subsequently, the driving velocity of the rear-end separation roller 140 is set based on the above-described table (S205). In S206, the rear-end separation roller 140 is rotated backward by a predetermined amount based on the setting table shown in FIG. 16. Subsequently, in S207, the rear-end separation roller 140 is rotated forward by the same amount so as to once warp the sheets. As a result of the above control, the sticking between the sheets can be alleviated.

Thereafter, the sheet is conveyed according to the procedure described in the first embodiment (S208 to S216). Then, when the job is not terminated in S214, the program proceeds to S206.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-120518, filed May 19, 2009, which is hereby incorporated by reference herein in its entirety.

What is claimed is:

1. A sheet feeding device which separates a sheet from a plurality of stacked sheets and feeds the sheet, the sheet feeding device comprising:

a sheet stacking portion on which the sheets are stacked;

an air blow portion which blows air to the sheets on the sheet stacking portion to blow the sheets upward;

a sheet feeding portion which draws and conveys the topmost sheet of the sheets blown upward by the air blow portion;

a separation rotating member which is rotatable upon abutting on a rear portion, in a feeding direction, of the sheets stacked on the sheet stacking portion and the separation rotating member rotates in a direction which returns the sheet;

a pressing force switching portion which changes a pressing force by the separation rotating member applied onto the sheets stacked on the sheet stacking portion; and a control portion which controls the pressing force switching portion to change the pressing force applied onto the sheets according to a basis weight of sheet to be fed.

2. The sheet feeding device according to claim 1, wherein the pressing force is set to be larger as the basis weight of the sheets to be fed becomes larger.

3. A sheet feeding device which separates a sheet from a plurality of stacked sheets and feeds the sheet, the sheet feeding device comprising:

a sheet stacking portion on which the sheets are stacked;

an air blow portion which blows air to the sheets on the sheet stacking portion to blow the sheets upward;

a sheet feeding portion which draws and conveys the topmost sheet of the sheets blown upward by the air blow portion;

a separation rotating member which is rotatable upon abutting on a rear portion, in a feeding direction, of the sheets stacked on the sheet stacking portion, and the separation rotating member rotates in a direction which returns the sheet;

a velocity switching portion which changes a rotational velocity of the separation rotating member; and a control portion which controls the velocity switching portion to change a relative velocity difference of the separation rotating member with respect to a sheet feeding velocity of the sheet feeding portion, according to the basis weight of sheet to be fed.

4. The sheet feeding device according to claim 3, wherein the relative velocity difference is set to be smaller as the basis weight of the sheets to be fed becomes smaller.

5. An image forming apparatus comprising:

a sheet stacking portion on which the sheets are stacked;

an air blow portion which blows air to the sheets on the sheet stacking portion to blow up the sheets;

a sheet feeding portion which draws and conveys the topmost sheet of the sheets blown up by the air blow portion;

a separation rotating member which is rotatable upon abutting on a rear portion, in a feeding direction, of the sheets stacked on the sheet stacking portion and the separation rotating member rotates in a direction which returns the sheet;

an image forming portion which forms an image on a sheet fed by the sheet feeding device;

a pressing force switching portion which changes a pressing force by the separation rotating member applied onto the sheets stacked on the sheet stacking portion; and a control portion which controls the pressing force switching portion to change the pressing force applied onto the sheets according to a basis weight of sheet to be fed.

6. The image forming apparatus according to claim 5, wherein the pressing force is set to be larger as the basis weight of the sheets to be fed becomes larger.

7. An image forming apparatus comprising:

a sheet stacking portion on which the sheets are stacked;

an air blow portion which blows air to the sheets on the sheet stacking portion to blow the sheets upward;

a sheet feeding portion which draws and conveys the topmost sheet of the sheets blown up by the air blow portion;

a separation rotating member which is rotatable upon abutting on a rear portion, in a feeding direction, of the sheets stacked on the sheet stacking portion, and the separation rotating member rotates in a direction which returns the sheet;

an image forming portion which forms an image on a sheet fed by the sheet feeding device;

a velocity switching portion which changes a rotational velocity of the separation rotating member; and a control portion which controls the velocity switching portion to change a relative velocity difference of the separation rotating member with respect to a sheet feeding velocity of the sheet feeding portion, according to the basis weight of sheet to be fed.

8. The image forming apparatus according to claim 7, wherein the relative velocity difference is set to be smaller as the basis weight of the sheets to be fed becomes smaller.

* * * * *